US006043469A

United States Patent [19]

Fink et al.

[11] Patent Number: 6,043,469

[45] Date of Patent: Mar. 28, 2000

[54] TAILORED MESH SUSCEPTORS FOR UNIFORM INDUCTION HEATING, CURING AND BONDING OF MATERIALS

[75] Inventors: Bruce K. Fink, Havre de Grace, Md.; John W. Gillespie, Jr., Hockessin; Shridhar Yarlagadda, Newark, both of Del.

[73] Assignee: The United States of America as represented by the Secretary of the Army, Washington, D.C.

[21] Appl. No.: 09/246,213

[22] Filed: Jan. 25, 1999

[51] Int. Cl.[7] ..... H05B 6/10

[52] U.S. Cl. ..... 219/634; 219/633

[58] Field of Search ..... 219/634, 603, 219/633, 630, 635, 645, 615, 608, 609; 72/60, 70

[56] References Cited

U.S. PATENT DOCUMENTS

| | | | |
|---|---|---|---|
| 4,029,837 | 6/1977 | Leatherman . | |
| 4,120,712 | 10/1978 | Sindt . | |
| 4,313,777 | 2/1982 | Buckley et al. . | |
| 5,313,037 | 5/1994 | Hansen et al. | 219/632 |
| 5,338,497 | 8/1994 | Murray et al. . | |
| 5,444,220 | 8/1995 | Hansen et al. . | |
| 5,500,511 | 3/1996 | Hansen et al. . | |
| 5,508,496 | 4/1996 | Hansen et al. | 219/633 |
| 5,624,594 | 4/1997 | Matsen et al. . | |
| 5,641,422 | 6/1997 | Matsen et al. . | |
| 5,645,744 | 7/1997 | Matsen et al. | 219/634 |
| 5,705,795 | 1/1998 | Anderson et al. | 219/633 |
| 5,717,191 | 2/1998 | Christensen et al. | 219/634 |
| 5,723,849 | 3/1998 | Matsen et al. | 219/633 |
| 5,728,309 | 3/1998 | Matsen et al. | 219/83 |
| 5,756,973 | 5/1998 | Kirkwood et al. | 219/634 |
| 5,760,379 | 6/1998 | Matsen et al. . | |
| 5,808,281 | 9/1998 | Matsen et al. | 219/634 |

OTHER PUBLICATIONS

Resistive Susceptor Design for Uniform Heating during Induction Bonding of Composites, S. Yarlagadda, B.K. Fink and J.W. Gillespie, Jr. Jornal of Thermoplastic Composite Materials vol. 11 Jul. 1998 pp. 321–337.

*Primary Examiner*—Teresa Walberg
*Assistant Examiner*—Jeffrey Pwu
*Attorney, Agent, or Firm*—Paul S. Clohan, Jr.; U. John Biffoni

[57] ABSTRACT

Mesh susceptors for use in induction heating and bonding processes are tailored to obtain more uniform heating across the susceptor and hence, the bondline, when bonding composite parts. The susceptors are tailored by cutting and removing segments from the mesh areas where the induced current and hence, heat generation, is highest. An algorithm is employed to predict the induced current patterns throughout the mesh so that areas of high heat generation can be identified and then cut and removed. In this way, essentially uniform temperatures in metal mesh susceptors may be achieved by specifically designed cut patterns within the mesh even though the mesh susceptor is subject to non-uniform magnetic fields.

19 Claims, 13 Drawing Sheets

TAILORED MESH SUSCEPTORS FOR UNIFORM INDUCTION HEATING, CURING AND BONDING OF MATERIALS

GOVERNMENT INTEREST

The invention described herein may be manufactured, used and/or licensed by or for the United States Government.

BACKGROUND OF THE INVENTION

1. Field of the Invention

The present invention pertains generally to processes involving induction heating, curing, and bonding for joining parts when manufacturing composite articles. More particularly, the present invention provides an improved method of manufacturing composite articles employing induction heating to cure and bond materials such as plastics, ceramics, composites and combinations thereof. Most particularly, this invention provides a method of tailoring mesh susceptors so that a more uniform temperature profile is maintained in the susceptor thereby uniformly focusing heat in the bondline during heating, curing, and bonding of composite materials.

2. Description of the Related Art

Induction-heated bonding of composites consists of the heating of an interlayer susceptor and the subsequent melting, flow, consolidation, and bonding of two thermoplastic-based adherends or the heating, consolidation, and cure of a thermosetting adhesive. Induction welding of thermoset composites incorporating a co-cured thermoplastic interlayer is also possible.

Susceptors are electrically conductive meshes which can be heated using the alternating magnetic field produced by an induction coil. These susceptors are, typically, metallic screen or mesh embedded in a matrix of the same composition as the composite part being welded, for purposes of compatibility. The susceptor is placed at the bondline between the parts to be fused, thereby focusing heat to the bond area. In this way, the metal mesh susceptor provides structural support to the composite part and a means by which the bond area may be heated upon exposure to an alternating magnetic field during manufacturing. Heating of the susceptor is caused by resistive heating of the conductive mesh due to voltages induced by the alternating magnetic field generated by an induction coil.

Electrically conductive mesh susceptors can be used in a variety of heating, curing and bonding applications including, but not limited to, plastics such as thermoplastic and thermoset materials, composites such as graphite or carbon fiber reinforced resin matrix composites, ceramics, and combinations thereof. The susceptors may be heated by either applying electrical currents directly to the susceptor or by inducing currents using alternating magnetic fields generated by induction coils. The prior art in the area of induction heating of mesh receptors has focused on plastics, and generally on bonding of composite parts.

Induction bonding of composites using mesh susceptors typically involves use of an induction coil, a power unit to generate high frequency currents, the mesh susceptor itself located at the bondline, and a thermoplastic or thermoset resin or adhesive to bond the parts of the assembly together at the bondline. The mesh susceptor is placed at the bondline and oriented such that its plane is perpendicular to the magnetic field lines generated by the induction coil. This positioning maximizes the induced currents in the mesh, which in turn maximizes the heat generated by the mesh at the bondline. The mesh is generally also placed as close to the coil as physically possible because the magnetic field decays rapidly with distance from the coil, and a reduced magnetic field reduces heat generated at the mesh.

The exponential decay of the strength of magnetic fields dictates that, in induction welding processes, the structure closest to the induction coil will be the hottest, since it experiences the strongest field. To avoid overheating of the outer surfaces and ensure adequate heating of the inner surfaces of the parts being joined, a susceptor of significantly higher conductivity than the parts is used to peak the heating selectively at the bondline of the parts when heating from one side. An electromagnetic induction coil on one side of the parts assembly heats the susceptor to melt or cure an adhesive to bond the parts of the assembly together.

Various devices and methods have been developed for induction heating, curing and bonding of materials using mesh susceptors. U.S. Pat. Nos. 4,029,837; 4,120,712; and 4,313,777 describe use of wire mesh susceptors having regular uniform shapes, i.e., having generally uniformly shaped and sized openings between the wires of the mesh. However, induction coils typically generate non-uniform magnetic fields resulting in temperature gradients exceeding the processing window required for composite heating or bonding. Consequently, in these devices and methods, large temperature gradients develop in the plane of the mesh ultimately resulting in weakened bond strength between the parts.

As a consequence, various systems have been developed to more uniformly heat composite parts. For example, U.S. Pat. No. 5,444,220 describes an asymmetric induction work coil for thermoplastic welding. The coil consists of two different types of windings that can be selectively activated for uniform heating. In addition, U.S. Pat. Nos. 5,624,594; 5,641,422; and 5,338,497 describe using non-metallic dies with built-in solenoid shaped coils or solenoid coils to generate uniform fields. The solenoids or round coils generate uniform fields within the coil, which is within the device, thus imposing limitations on the size of the parts that can be bonded using these devices.

Mesh susceptors have also been tailored for particular use with various induction heating and bonding systems. For example, U.S. Pat. Nos. 5,500,511 and 5,508,496 describe tailored and selvaged susceptors, respectively. These susceptors have been designed to reduce impedance at the edges of the mesh to counterbalance the high current density occurring at the edges of the mesh. This was accomplished by altering the aspect ratio of the openings of the mesh, folding the mesh over on itself, or using edge strips devoid of openings. For these susceptors, the coil and part configurations of the induction heating systems were such that eddy currents that the magnetic field induced in the susceptors produced higher current density at the edges of the susceptors than in the center, which produced overheating and underheating effects. Overheating occurred at the edges of the mesh susceptors and the goal of tailoring the susceptors was to mitigate these effects. This problem typically occurs when using a cup core induction coil like that described in U.S. Pat. No. 5,313,037. However, for different coil and part configurations, overheating is not necessarily confined to the edges of the mesh, but rather, is dependent on the relative size of the coil and the part. In such cases, non-uniform heating is not confined to the edges and can occur elsewhere within the mesh. Reducing edge impedance does not help reduce thermal gradients. The present invention will address this shortcoming.

SUMMARY OF THE INVENTION

Accordingly, it is an object of the present invention to provide a method of reducing the non-uniformity of temperatures in the plane of mesh susceptors when used in induction heating, curing and bonding processes for joining plastics, composites, ceramics and combinations thereof.

It is a further object of the present invention to improve the strength and uniformity of the bond joining assembly parts made by induction heating processes.

It is a further object of the present invention to provide a method of reducing the non-uniformity of temperatures in the plane of mesh susceptors for any given induction heating coil system or device and part configuration.

It is a further object of the present invention to provide a method of reducing the non-uniformity of temperatures in the plane of mesh susceptors having any given size, shape, density, or pattern.

It is a further object of the present invention to provide a method for reducing the non-uniformity of temperatures in the plane of any given mesh susceptor by tailoring said susceptor by selectively cutting or removing mesh segments.

It is a further object of the present invention to provide a method which uses a computer algorithm to predict heating patterns in cut and uncut meshes for designing and choosing cut patterns for reducing electrical current gradients and reducing temperature gradients within mesh susceptors.

It is a further object of the present invention to provide tailored mesh susceptors having specifically designed mesh patterns, which reduce the non-uniformity of temperature in the plane of the mesh susceptor.

Other objects of and advantages of the present invention will become apparent as a description thereof proceeds.

In satisfaction of the foregoing objects and advantages, the present invention provides a method of tailoring mesh susceptors used in induction heating processes which comprises: using a prediction algorithm to identify the largest contiguous electrically conductive path within the mesh, i.e., that path carrying the largest induced current; selectively cutting mesh segments within the region of this path; and iterating until the thermal distribution (temperature gradient) throughout the mesh is reduced to within permissible levels for the particular bonding process. In addition, the present invention includes these tailored mesh susceptors having specifically designed cut patterns therein. The principle advantage of the susceptors of the present invention is that they provide uniform inplane temperatures during induction heating.

DESCRIPTION OF THE PREFERRED EMBODIMENT

Figure 1A:
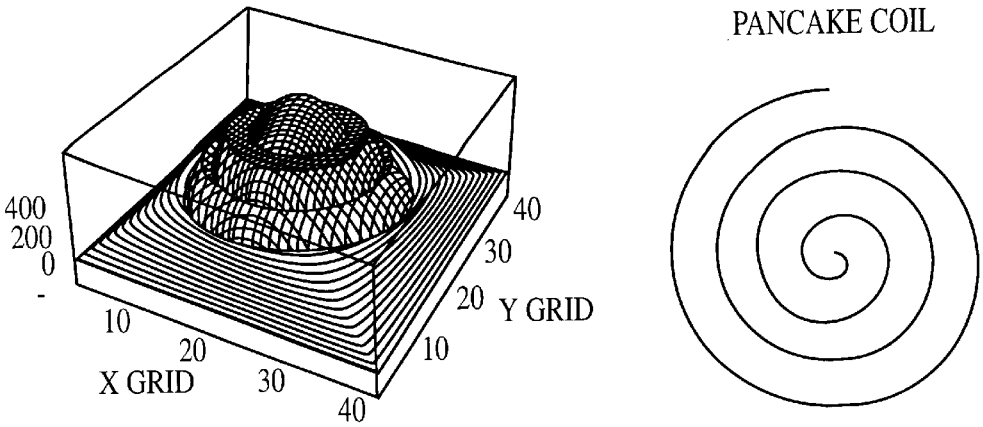
FIG. 1*a* is a graph showing the magnetic field generated by a commonly used pancake induction coil over the various mesh segments of a 40×40 mesh having a mesh-coil separation of 1 centimeter. Only the Z component of the generated field is of interest because it is the component normal to the surface of the mesh susceptor and causes heating.

The subject matter of the present invention pertains to the manufacture of articles comprising composite parts, wherein said parts are heated, cured, and bonded together using induction heating processes. The improvement to induction heating methods provided by the present invention is applicable to the manufacturing of composite articles in a wide variety of bonding, welding, or molding techniques well known to those skilled in the art. It should be understood as a preliminary matter that the term "composite articles" as used herein refers to an article comprising one or more thermally bondable parts which are joined by induction heating. The thermally bondable parts may be comprised of plastics, ceramics, composites such as graphite or carbon fiber reinforced resin matrix composites, or any other material, which is susceptible to thermal bonding. Thermal bonding ordinarily also includes use of a thermoplastic resin or adhesive.

Induction heating, curing, and bonding of composite articles typically includes the use of an electrically conductive mesh susceptor placed at the bondline between the parts and oriented such that its plane is perpendicular to the magnetic field lines generated by an induction coil. The mesh susceptor may be made of any material having good electrical conductivity or high magnetic permeability, for example, metals such as copper, aluminum, silver or gold; and also ferromagnetic materials heatable by alternating magnetic fields such as steel, iron, nickel, cobalt or alloys of these metals.

In general, the susceptor may comprise a thin metal mesh sheet, screen or foil having a thickness of, for example, less than 0.01 inches and with a regularly shaped pattern of openings such as diamonds or squares. The susceptors used in induction heating processes typically have openings having generally uniform aspect ratios, i.e., length/width ratio, and density, i.e., number of openings per square inch. When placed between the parts being joined, susceptors are often embedded in a thermoplastic or thermoset resin or adhesive, which aids the bonding process. In addition, "smart" susceptors are also commonly used so that the possibility of disastrous overheating is reduced. "Smart" susceptors are made from magnetic alloys that have high magnetic permeability but that also have their magnetic permeabilities fall to unity at their Curie temperature. At the Curie temperature, then, the susceptors become inefficient heaters.

In coil induction heating systems, the induction coil induces eddy currents in a nonlinear distribution across the width of the susceptor. In these systems, the coil is generally aligned directly over the susceptor and moves longitudinally over the article parallel to the bondline. Current in the coil generates an alternating magnetic field which induces eddy currents in the susceptor in direct proportion to the magnetic field strength. For these systems, the coil generates fields dependent on the coil geometry generally resulting in non-uniform fields. Therefore, the induced currents in the susceptor are nonlinear and the resulting heating would be nonuniform unless the susceptor is tailored to adjust its impedance to counter the change in the current and current density that the coil induces.

The power (P) is a function of the current (I) and the resistance (R) (i.e. impedance), given by $P=I^2R$. Therefore, if the eddy current doubles, to maintain P constant, the impedance must decrease to one-fourth its initial value.

The present invention provides a new method for improving the thermal control in induction heating processes by improving the uniformity of temperature or heating in mesh susceptors. The terms "uniformity of temperature" or "uniform heating" as used herein does not necessarily mean the same temperature or heating throughout the mesh. Instead, the goal is to maintain the temperature distribution or heating gradient within the mesh to within acceptable limits to ensure optimal bonding properties.

It is, therefore, well known that for commonly used induction coils the magnetic fields generated are non-uniform resulting in non-uniform heat generation and significant temperature gradients over the susceptor mesh area. The principle of the present invention is that uniform temperatures in a metal mesh susceptor may be achieved by specifically designed cut patterns in the mesh, even though the mesh is subject to non-uniform magnetic fields. Mesh optimization is required to identify the best possible cut pattern to achieve temperature uniformity for any given system.

The design of cut patterns in the mesh susceptors is such that the temperature gradient in the plane of the mesh susceptor is reduced to within acceptable processing limits ensuring optimal bonding properties. If we consider the region of the mesh having the largest contiguous electrically conductive path induced by the induction coil, we will have identified the path in the mesh carrying the most induced current, and therefore, generating the most heat. Removing one or more mesh segments within this path will alter the induced currents. In order to determine the particular cut pattern required for a particular application, a mesh design algorithm which predicts induced currents for various cut patterns has been developed. The algorithm predicts all the induced current-carrying electrical pathways in the mesh, and hence the heating patterns, as various segments of a mesh susceptor are cut, and iterates until it specifies a mesh cutting pattern which reduces temperature gradients to within acceptable limits. The algorithm and the mesh segment cutting process can be used to increase temperature uniformity within a mesh susceptor for any induction coil type, part shape or size. Therefore, the present invention has application in any existing induction heating, curing, and bonding system using mesh susceptors, in field-repair of composites using induction heating systems, and in the development of portable repair units.

Even a uniform magnetic field, such as that within a solenoid coil, is not sufficient to obtain uniform heating at the bondline. Heating at the bondline is a function of the magnetic field, susceptor geometry, and the thermal properties of the susceptor material and the parts being bonded. All of these variables must be considered simultaneously when designing a cut pattern for a particular mesh. However, to maintain maximum flexibility for any part size or shape it is preferable to tailor the mesh susceptor alone to obtain uniform heating rather than modifying the coil and other parameters. The present invention provides a method of accomplishing this desired result.

The cutting and removal of a segment of a given mesh susceptor causes a change in the induced current flow pattern within that susceptor, i.e., the eddy current flow pattern in the cut mesh differs from the eddy current flow pattern in the uncut mesh. Selectively cutting and removing mesh segments can modify the induced current pattern in such a way as to reduce induced current gradients and hence thermal gradients. Cuts in regions of high electrical current will force induced currents to flow into adjacent mesh segments thereby reducing thermal (temperature) gradients.

A computer algorithm has been developed to predict or identify the electrical current path, and hence the induced current and heating patterns, in uncut and cut mesh susceptors. This algorithm forms the basis for designing or choosing cutting patterns within the mesh that will reduce electrical current gradients and thereby reduce thermal distribution temperature gradients.

Predicting heat generation in a metal mesh susceptor with cut patterns involves two main steps: (1) calculating the magnetic field generated by the induction coil; and (2) calculating the heat generated due to eddy currents in the mesh susceptor.

The magnetic field generated by the coil is calculated based on fundamental electromagnetic principles. The general formula for the magnetic field intensity H, at some point P, due to electrical current I in an element of conductor is given by:

$$dH = \frac{1}{4\pi}\frac{dl \times r}{|r|^3} \quad [A/m] \qquad \text{(Equation 1)}$$

where dl is an element of the current carrying conductor, and r is the position vector between the element dl and the point P. By integrating over the whole length of the conductor (the coil in this case), we can obtain the magnetic field intensity H at P, due to the entire induction coil of length L, as $$H = \frac{I}{4\pi}\int_0^L \frac{dl \times r}{|r|^3} \quad [A/m]. \qquad \text{(Equation 2)}$$

The integral can become quite complicated depending on the coil shape, necessitating the use of numerical techniques to evaluate the intensity at each point. In the algorithm the field was calculated over a 40×40 grid on a surface (the area to be heated) which is some known distance from the coil. This is typically the case in an induction heating application where the workpiece is placed at a specified distance from the coil.

Figure 1B:
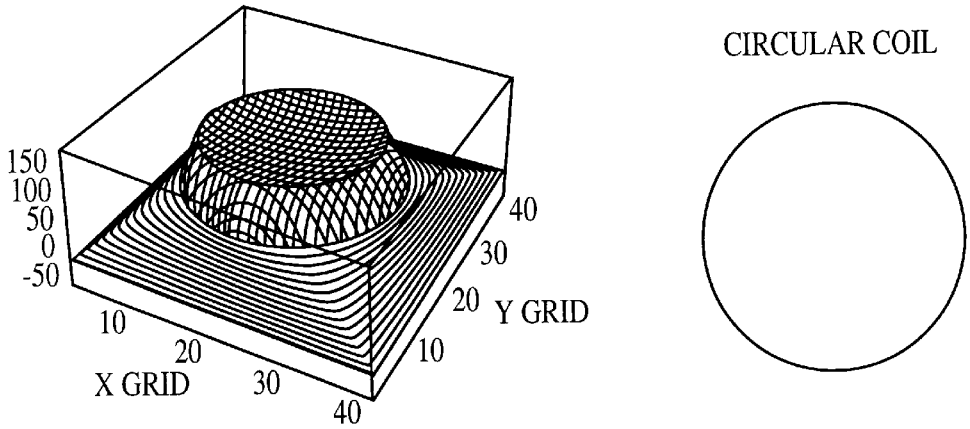
FIG. 1*b* is a graph showing the magnetic field generated by a commonly used circular induction coil over the various mesh segments of a 40×40 mesh having a mesh-coil separation of 1 centimeter. The Z component of the magnetic field normal to the surface of the mesh is shown.
Figure 1C:
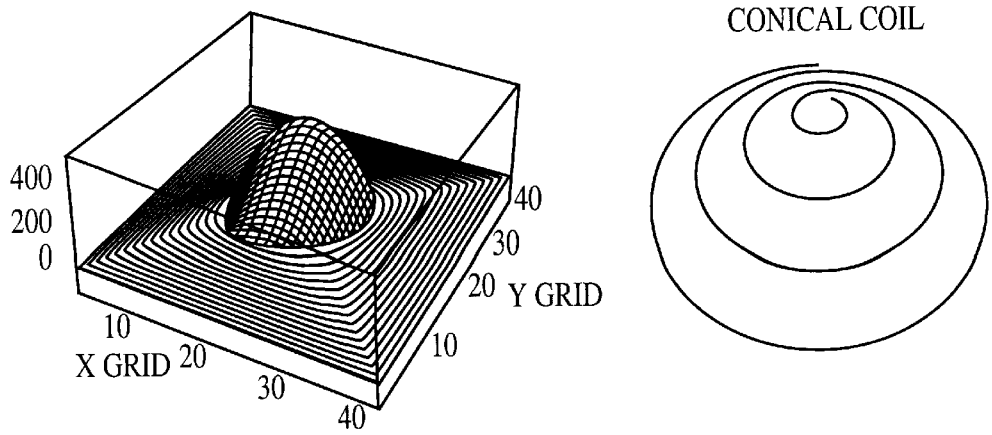
FIG. 1*c* is a graph showing the magnetic field generated by a commonly used conical induction coil over the various mesh segments of a 40×40 mesh having a mesh-coil separation of 1 centimeter. The Z component of the magnetic field normal to the surface of the mesh is shown.

FIGS. 1*a*, 1*b*, and 1*c* show the magnetic fields generated by three commonly used induction coils over the various mesh segments of the 40×40 mesh having a mesh-coil separation of 1 centimeter. Only the Z component of the generated field is of interest because it is the component normal to the surface of the mesh susceptor and causes heating. The circular coil of FIG. 1*b* shows a region within the coil where the field is more uniform. This is the ideal magnetic field pattern for generating uniform temperatures in the susceptor. However, circular coils are best suited for cases where the parts to be bonded can be placed inside the coil, which in general represents a severe geometric constraint. Pancake and conical coils are more commonly used "one-sided" coils and they generate non-uniform fields as shown in FIGS. 1*a* and 1*c*. These figures clearly demonstrate a significant variation in magnetic field intensity across the various mesh segments. Such variation in field intensity results in significant variation in currents and temperatures throughout the mesh.

Figure 2:
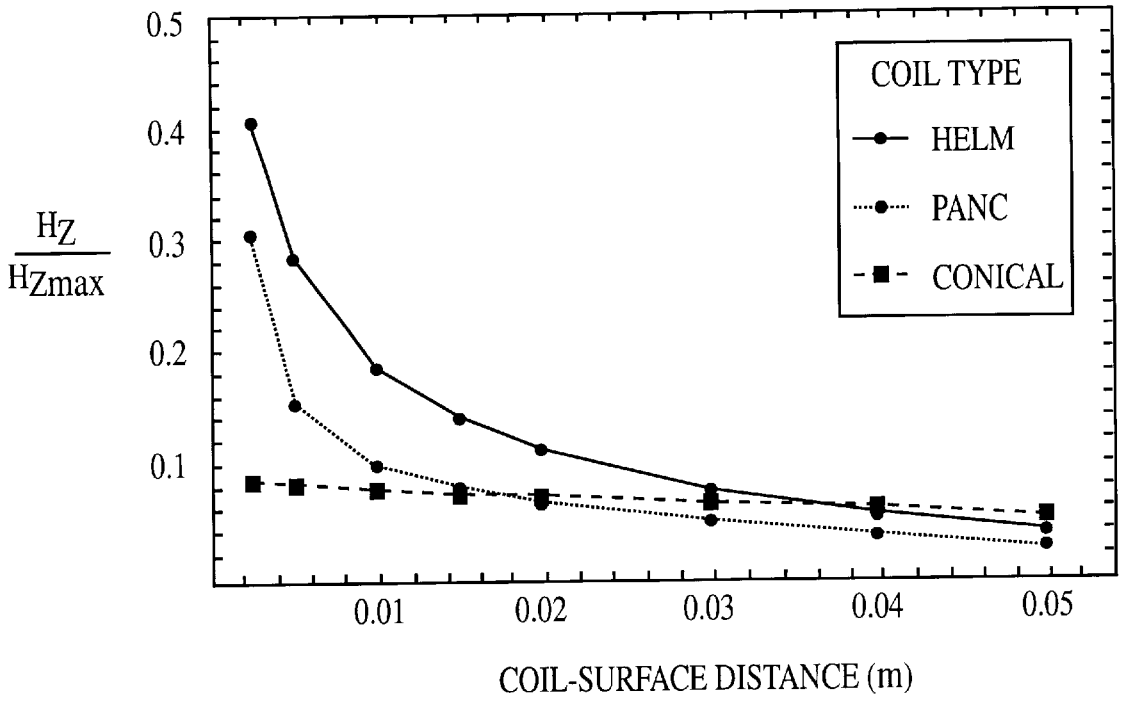
FIG. 2 is a graph showing the effect of coil-susceptor spacing on magnetic field intensity. $H_z$ is the field intensity at the center of the coil, and $H_{zmax}$ is the field intensity at the same point for a separation of 1 mm, assumed to be the closest possible location.

The spacing between the induction coil and the susceptor also effects the magnetic field in the plane of the susceptor. FIG. 2 shows the effect of increasing he coil-susceptor spacing. $H_z$ is the field intensity at the center of the coil, and $H_{zmax}$ is the field intensity at the same point for a separation distance of 1 millimeter, which was assumed to be the closest possible location of a susceptor. As expected from theory (See Equation 2), the magnetic field decays exponentially with distance from the coil resulting in a similar reduction in the heat generated by the susceptor. However, metal mesh susceptors require much smaller amounts of magnetic energy for heating compared to bulk materials and, in some cases, the distance problem can be overcome by increasing the input power to the coil or by increasing the frequency of the current in the induction coil. For example, typical metallic heating applications use kHz range currents, which may be increased up to several MHz when higher heating rates are required.

Of course, in metal mesh susceptors heat is generated in each mesh segment due to eddy currents induced by an alternating magnetic field. The uniformity of current generated in the mesh depends on both the coil and the mesh configuration. It is a well-known problem that for general or commonly used induction coils, the generated fields are non-uniform, resulting in non-uniform heat generation and significant temperature gradients over the mesh area. Experiments conducted with course aluminum meshes showed gradients of over 80° C. in a 6.25 cm by 6.25 cm mesh.

The area of the mesh where the heat generation is highest will be that area which is carrying the most induced eddy current. Removing one or more mesh segments will alter the induced current flowpattern in the mesh. By selectively removing segments of the mesh, one can alter the induced current pattern such that the resulting heating patterns and temperature distributions are more uniform and within the desired processing window. Thus, uniform temperature in a mesh susceptor, subject to non-uniform magnetic fields, may be achieved by specifically designed cut patterns in the mesh, based on the induction coil and mesh used. Mesh optimization is used to identify the best possible cut pattern.

The alternating magnetic field generated by an induction coil induces eddy currents in the mesh susceptor, and the resistance of the mesh material produces heat. The induced electromotive force (emf) in a closed loop in the mesh can be calculated from $$\text{emf} = 2\pi f \mu_0 \int_S H \cdot n dA = 2\pi f \mu_0 \sum_{i=1}^{m}\sum_{j=1}^{n} H_{2ij} dA \qquad \text{(Equation 3)}$$

where f is the current frequency, $\mu_o$ is the permittivity in free space, n is a unit vector normal to the mesh surface, and $H_z$ is the z component of the magnetic field at the surface of the mesh. The double summation is used instead of the area integral because of the field being calculated numerically over an m×n grid. For example, if a 10×10 square mesh was used and the field calculated over a 40×40 grid, each mesh box would have a 4×4 grid of magnetic field values to calculate the emf.

A susceptor mesh typically has a number of segments forming closed boxes, or different box-like shapes, in the case of cut or stamped patterns. Since the mesh has a number of closed loops and different loop shapes (in the case of the cut patterns), a resistor network type calculation is used to determine the emf in each segment of the mesh.

Each segment of the mesh was assumed to carry an unknown voltage or current. Current conservation laws were then applied at each mesh box corner and node and along with the emf equations for each closed loop (induced emf equals the sum of the voltages in the loop), a set of linear algebraic equations were obtained which can be solved for the unknown currents. In addition, knowing the resistance of each segment (from wire geometry and material resistivity), the heat generated in each segment of a mesh box can be calculated. However, determining the actual heat generated in each segment is not necessary in order to use the algorithm to determine which segments are carrying the greatest heat load. That is, regardless of wire geometry and material resistivity (these parameters will be uniform for meshes having uniform wire size and materials), the current conservation laws and induced voltage equations can be solved to determine currents in each segment. The highest current carrying segment, i.e., that comprising the largest contiguous electrically conductive path, will generate the most heat in the mesh.

Figure 3:
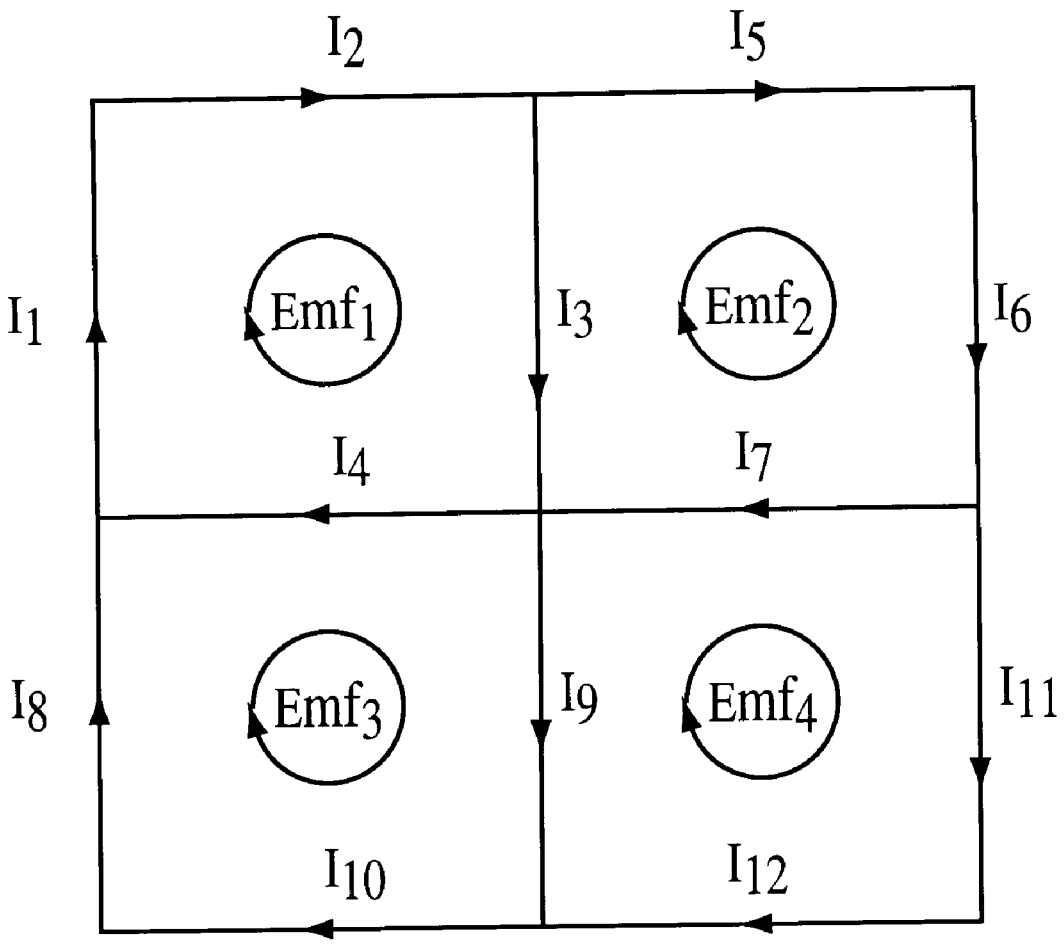
FIG. 3 shows a simple 2×2 square uncut mesh showing the induced current and induced voltage for segments of the mesh.

Turning now to FIG. 3, the algorithm is described and outlined as set forth below for a simple 2×2 square mesh to illustrate the method. The uncut 2×2 mesh is shown in FIG. 3. For this 2×2 mesh, with each segment having resistance R, the induced emf and current conservation equations are:

Induced Emf:

$$I_1+I_2+I_3+I_4=\text{Emf}_1/R$$

$$-I_3+I_5+I_6+I_7=\text{Emf}_2/R$$

$$-I_4+I_8+I_9+I_{10}=\text{Emf}_3/R$$

$$-I_9-I_7+I_{11}+I_{12}=\text{Emf}_4/R$$

Current Conservation at nodes:

$$I_1=I_2;\ I_5=I_6;I_{11}=I_{12};I_8=I_{10}$$

$$I_2=I_3+I_5$$

$$I_6=I_7+I_{11}$$

$$I_9+I_{12}=I_{10}$$

$$I_8+I_4=I_1$$

$$I_3+I_7=I_4+I_9$$

The resulting system of 12 unknown I's and 13 equations is solved to calculate currents induced in the mesh segments. Because the system of equations is linear, solving large systems for fine or high density meshes is not a significant computational exercise and can be done in a relatively short time. Symmetry of field and mesh can also be used to reduce computational time.

Figure 4:
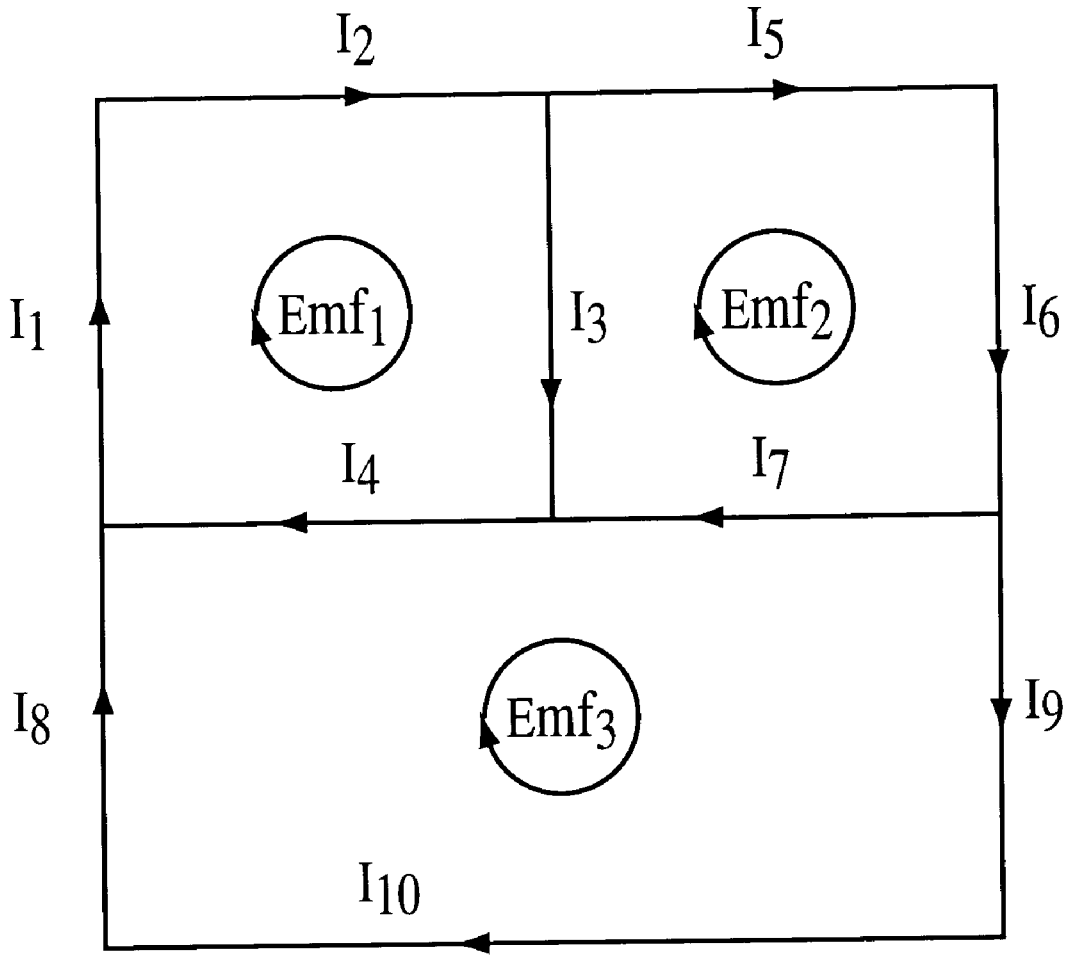
FIG. 4 shows the same mesh as in FIG. 3, but with one segment removed and the resulting current and induced voltage for the remaining segments of the mesh.

To generate uniform temperature distributions within the mesh susceptor, segments of the mesh can be cut and removed to redirect eddy current flow patterns within the mesh. Based on the applied field distribution, preferential heating will occur and cutting segments will force changes in the path of the current flow in the mesh and can equalize heating to some extent. The current calculation method outlined above can be easily adapted for a cut mesh case. We now turn to FIG. 4, which shows the same mesh as FIG. 3 but with one segment cut and removed. The induced emf and current conservation equations are:

Induced Emf:

$$I_1+I_2+I_3+I_4=\mathrm{Emf}_1/R$$

$$-I_3+I_5+I_6+I_7=\mathrm{Emf}_2/R$$

$$-I_4-I_7+I_8+I_9+I_{10}=\mathrm{Emf}_3/R$$

Current Conservation at nodes:

$$I_1=I_2;I_5=I_6;I_8=I_{10};I_9=I_{10}$$

$$I_2=I_3+I_5$$

$$I_8+I_4=I_1$$

$$I_6=I_7+I_9$$

$$I_3+I_7=I_4$$

Comparing the above equations with the uncut case of FIG. 3, the induced emf s are different. Cutting one segment forces a "re-direction" of the current loops, resulting in significantly different heat generation in each mesh segment. Larger meshes and more complicated cut patterns can easily be handled by this method, and a computer algorithm has been developed for this purpose.

The method outlined above can successfully handle any current configuration in the mesh and predict the appropriate induced currents and voltages. Meshes of up to 40×40, with many different cut patterns have been solved by this method.

Figure 5:
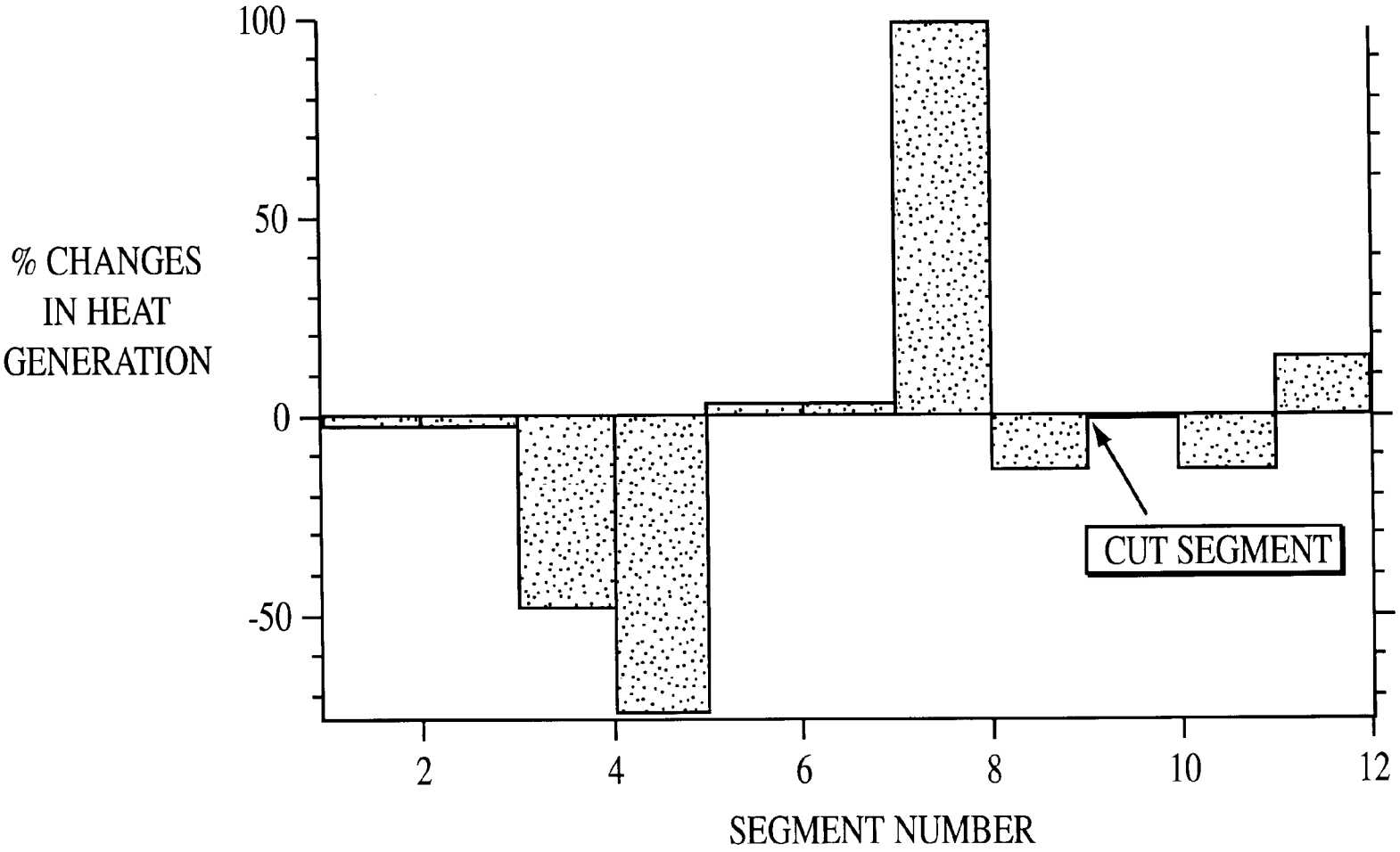
FIG. 5 shows the percentage change in the resulting heat generated for each segment of the mesh of FIG. 3 after one segment was removed as in FIG. 4.

FIG. 5 shows the predicted percentage change in the heat generation in each segment of the 2×2 mesh as a result of the segment being cut and removed form the pattern. As can be seen, several segments show significant changes in heat generation with just one segment removed. With larger and denser meshes, as is the case in general, much greater control over the heat generation pattern is possible.

This method, and the algorithm employed to carry out the method, is capable of predicting thermal distribution in any size or shape mesh susceptor for any cut pattern in the mesh. Starting with the uncut case which exhibits large heat generation gradients, one can selectively cut mesh segments showing the highest heat generation and iterate for the new resulting pattern until the gradients within the mesh are reduced to within permissible levels for the process.

HEAT GENERATION ALGORITHM PREDICTIONS

Figure 7:
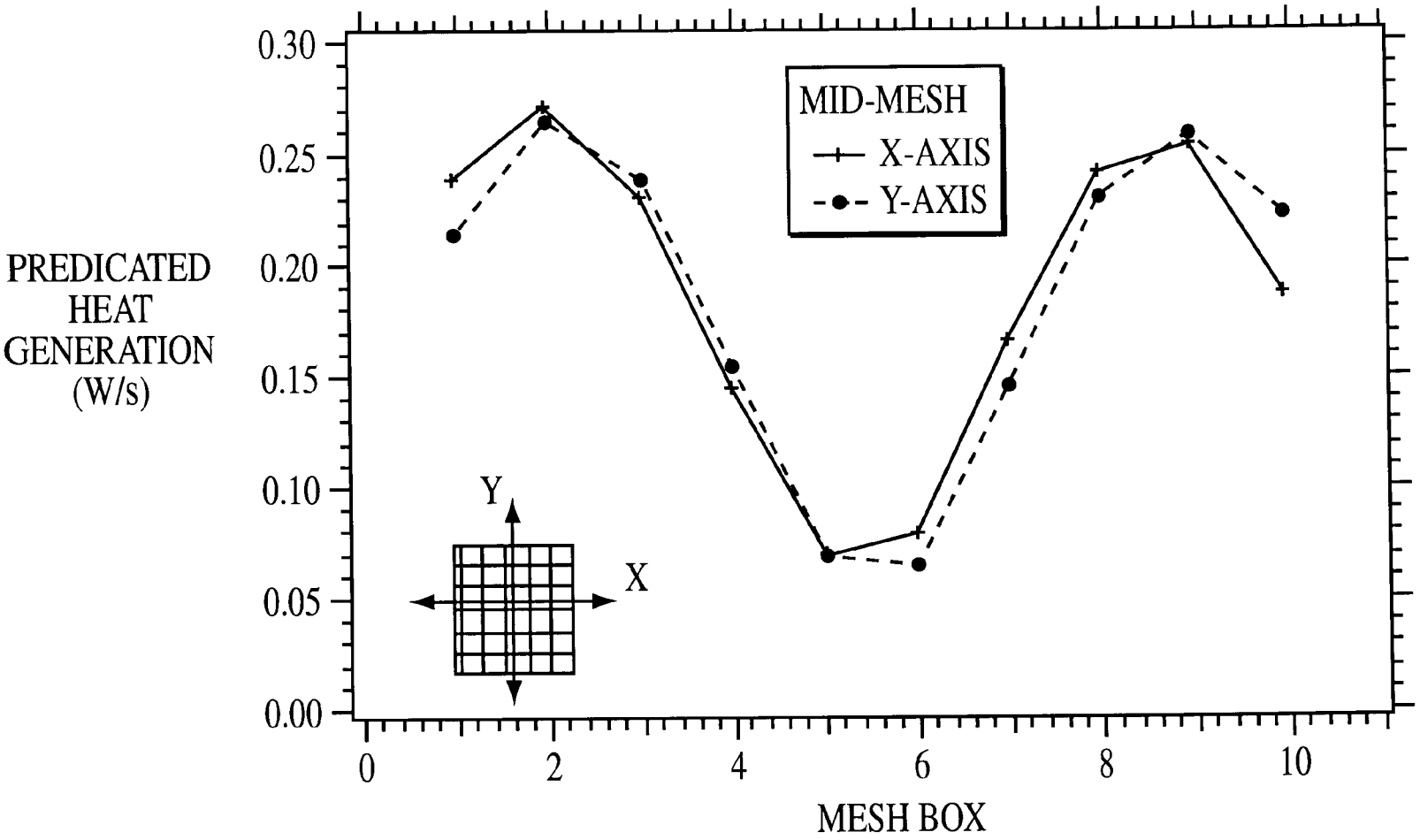
FIG. 7 is a graph showing the typical heat generation profile for a 10×10 square uncut mesh susceptor subject to the magnetic field of the 4-turn pancake coil of FIG. 1*a*.

FIG. 7 shows typical heat generation profiles for an uncut mesh susceptor subject to the field generated by the 4-turn pancake coil whose field is shown in FIG. 1*a*. The two curves show the profiles at the midlines of a 10×10 square (6.25 cm×6.25 cm) aluminum mesh, in the X and Y directions. As expected, the heat generation profiles are non-uniform, which is the main drawback to using non-optimal coil/mesh susceptor combinations. A mesh gradient factor (MGF), defined as, $$MGF=\frac{\text{Maximum Heat Generated}}{\text{Minimum Heat Generated}}$$

can be used as a quality factor. For the heat generation profile in FIG. 7, this factor is approximately 4.7, which implies a large temperature gradient, along either axis.

Figure 8:
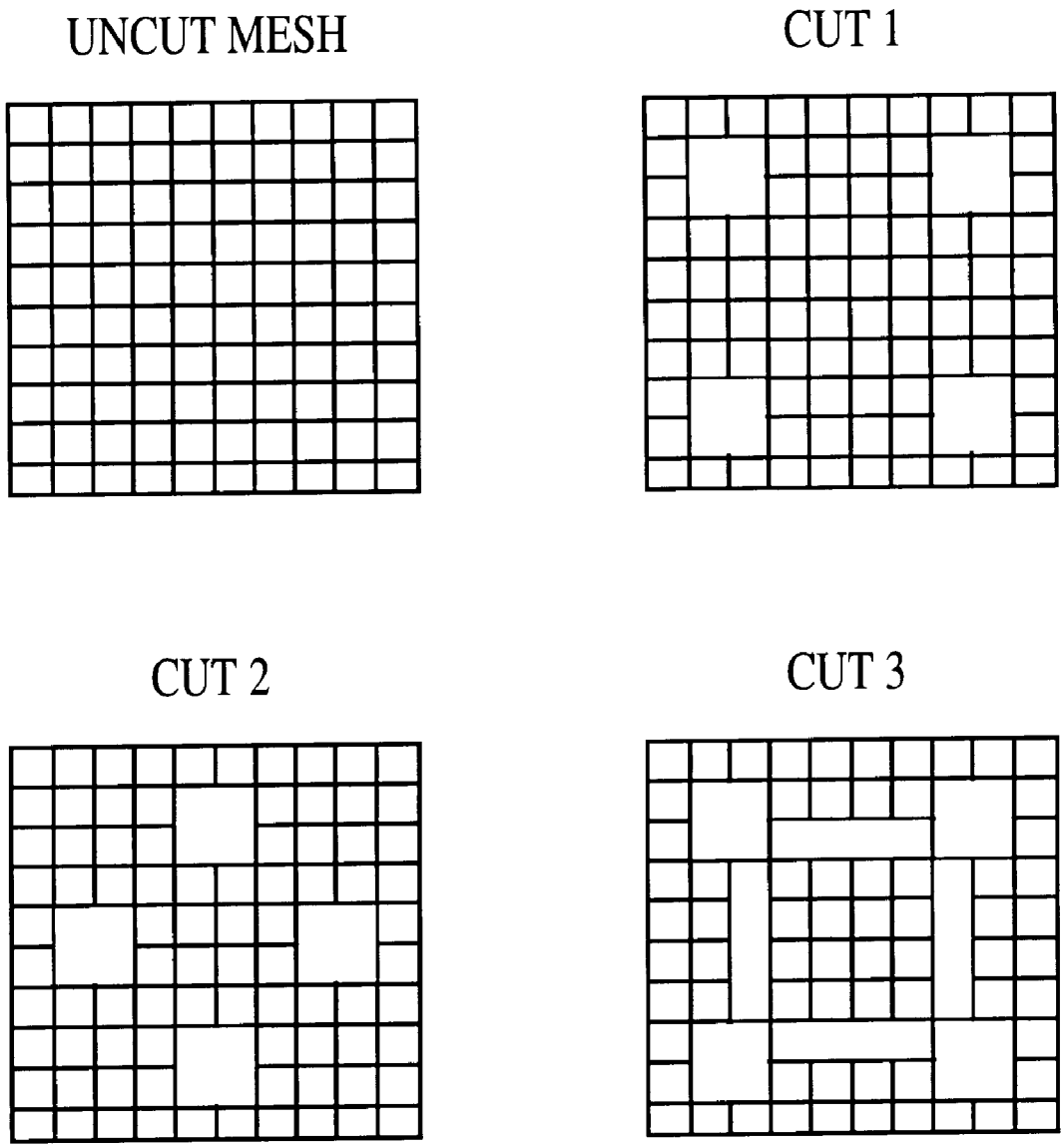
FIG. 8 is a diagram of an uncut mesh and three different cut patterns in the mesh.
Figure 9:
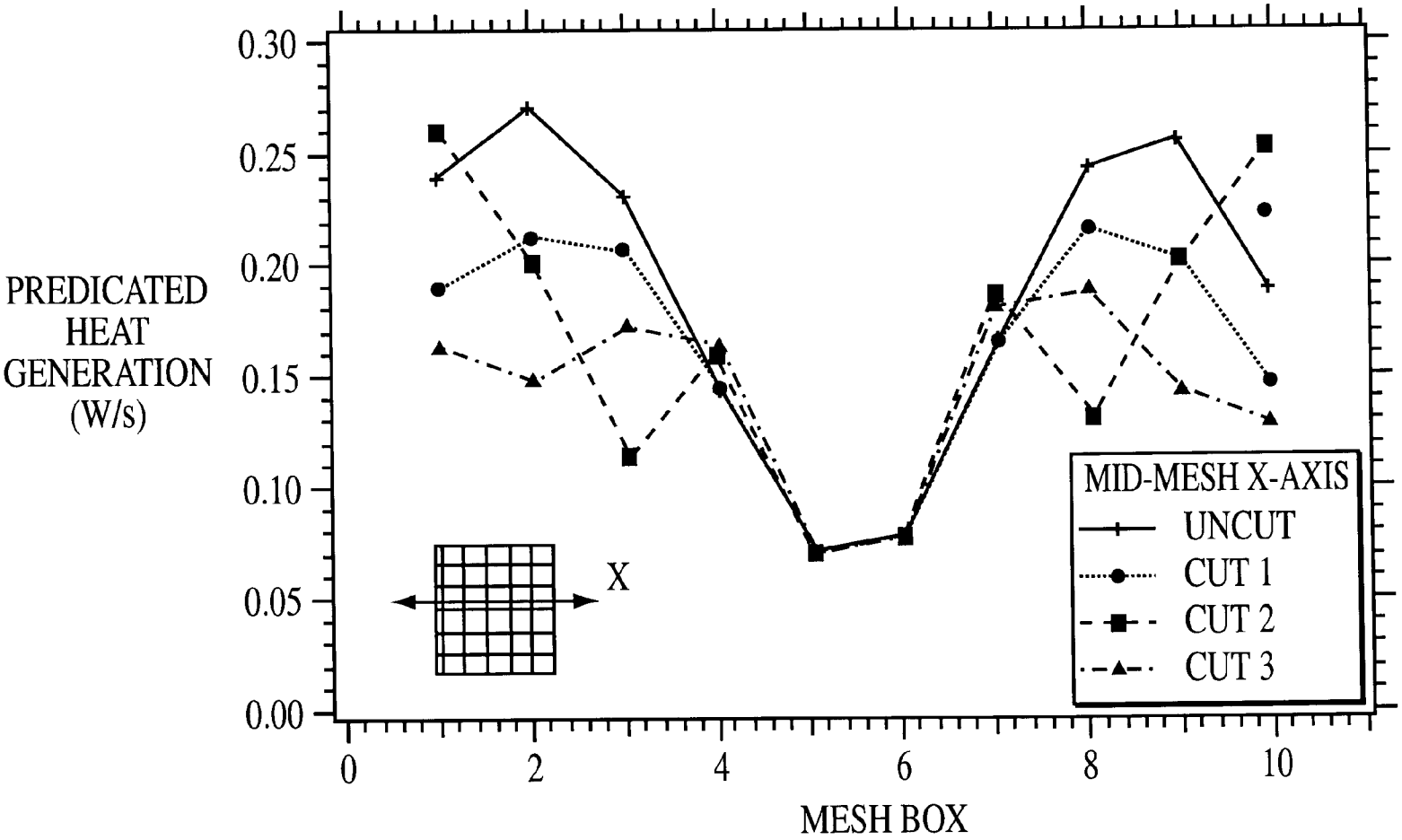
FIG. 9 is a graph showing the heat generation predicted by the prediction algorithm in the X-axis for the uncut mesh and the three cut mesh patterns of FIG. 8.
Figure 10:
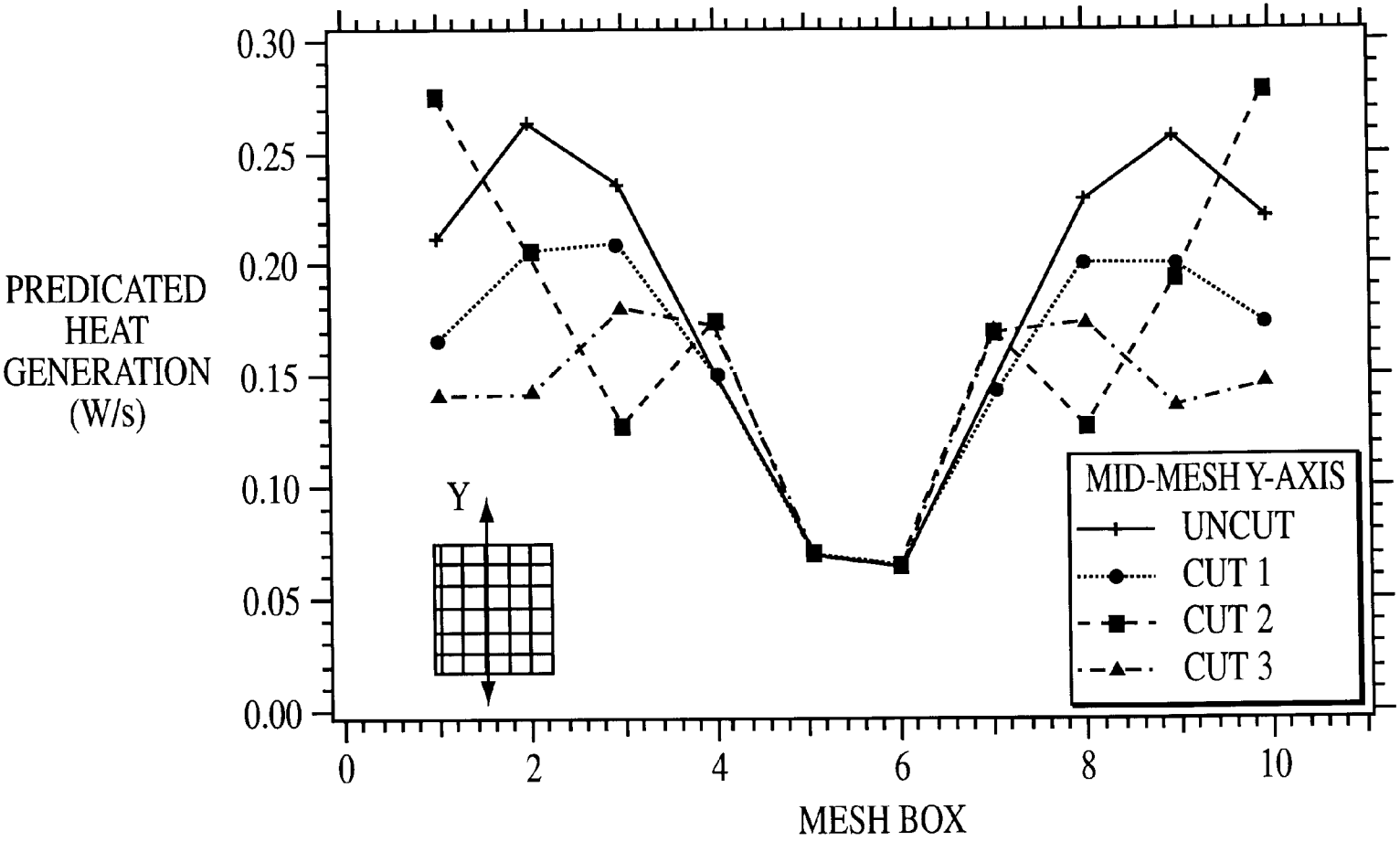
FIG. 10 is a graph showing the heat generation predicted by the prediction algorithm in the Y-axis for the uncut mesh and the three cut mesh patterns of FIG. 8.

The response of three different cut patterns, shown in FIG. 8, to the 4-turn pancake coil of FIG. 1*a*, are shown in FIGS. 9 and 10, with comparison to the uncut case. FIG. 9 shows the predicted heat generation for the uncut and cut patterns in the X-axis, while FIG. 10 shows the same in the Y-axis. As expected, the uncut case shows the highest heat generation differential along either the X or Y direction. The cut locations were chosen at points where the induced current was highest for the uncut case, and with just a few cuts a significant drop in heat generation gradient is seen.

The MGF's in the three cut cases are 4.5, 3.6, and 2.9, respectively, which demonstrates improvement in temperature uniformity over the uncut case (MGF 4.7). The lower the MGF ratio, the more uniform the temperature distribution will be. While it is expected that impregnation of the mesh with polymer will reduce the gradient somewhat, due to conduction in the polymer, the reduction will be small due to the high heating rates in the mesh.

EXAMPLE

Figure 6:
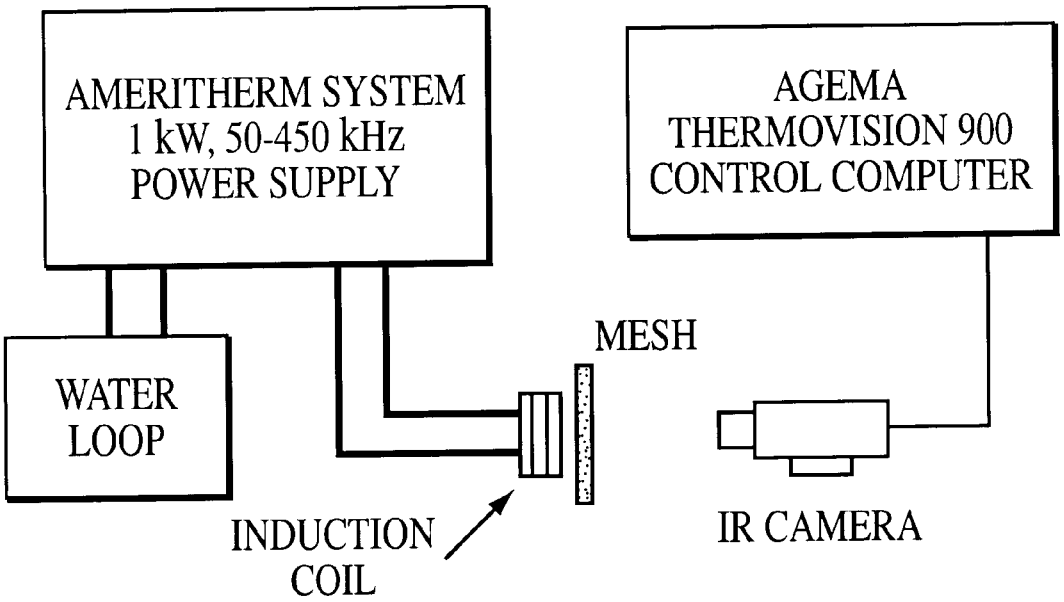
FIG. 6 is a schematic of the induction heating system test setup.

To demonstrate the effectiveness of designed cut patterns, temperature measurements of inductively heated aluminum meshes, with and without cut patterns were compared. The test set-up is as shown in FIG. 6. A water-cooled 1 kW Ameritherm induction heating system was used, with a frequency range of 50 to 450 kHz. The induction coil was fabricated from copper tubing, ranging from 0.125 inch to 0.25 inch in outer diameter, to facilitate water cooling during operation. The coil used was a 3.75 cm diameter circular induction coil. Course aluminum meshes having mesh densities of 4×4 per square inch were used as test meshes and placed at a constant separation distance of 1 cm from the coil. Temperatures in the mesh were measured by infrared thermography using an AGEMA Thermovision 900 system, which permitted far-field, non-contact temperature measurements.

Figure 11:
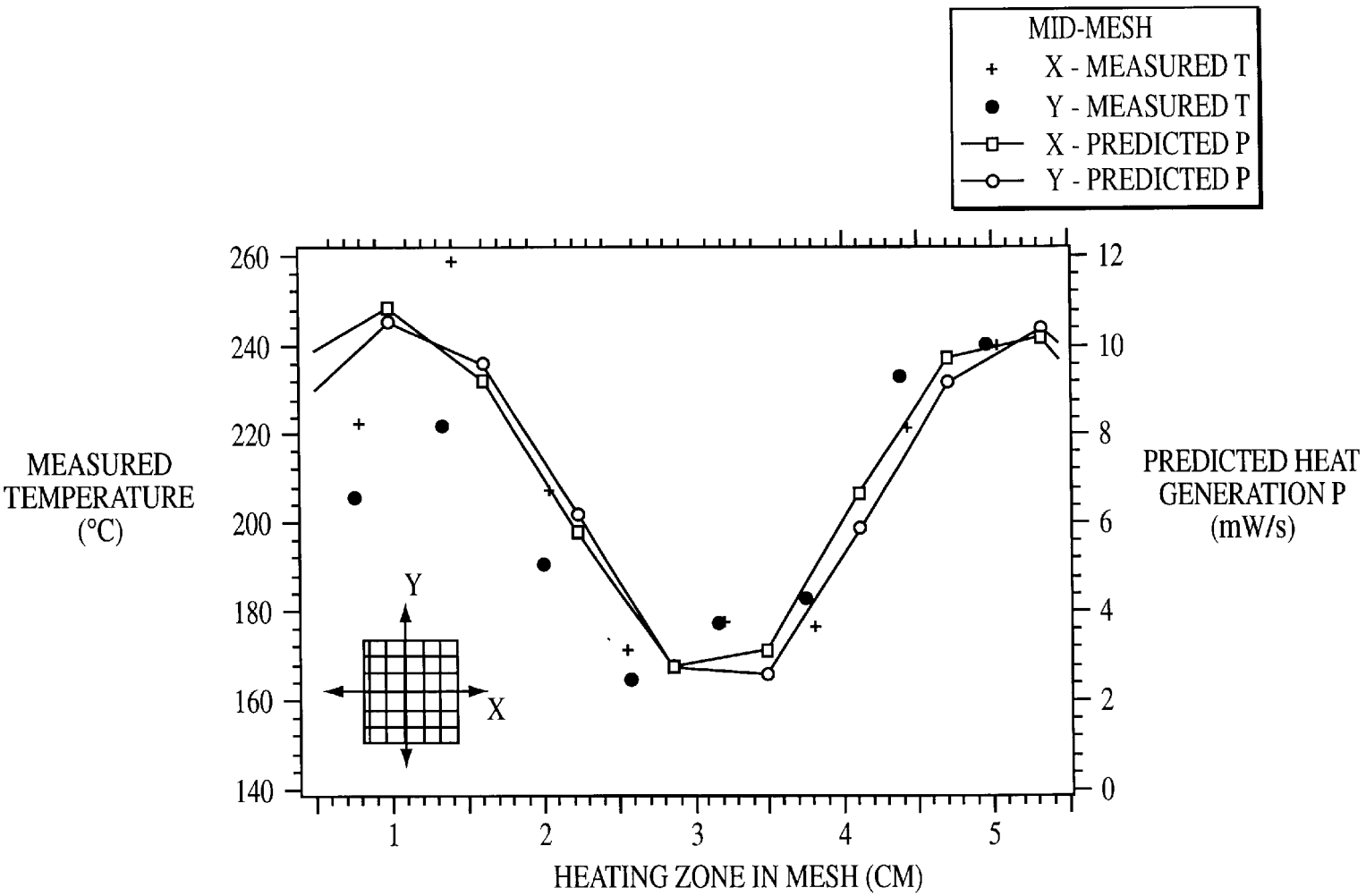
FIG. 11 is a graph showing the experimentally measured temperatures and predicted temperatures within the heating zone of an uncut mesh.

Experiments were conducted with the coarse aluminum meshes to measure temperature distributions in the mesh during heating. FIG. 11 shows the results for an uncut mesh case, with measured temperature profiles and predicted heat generation along the X-axis and the Y-axis. The temperature profiles follow the predicted heat generation patterns very well and this serves as a good qualitative check for the method.

Figure 12:
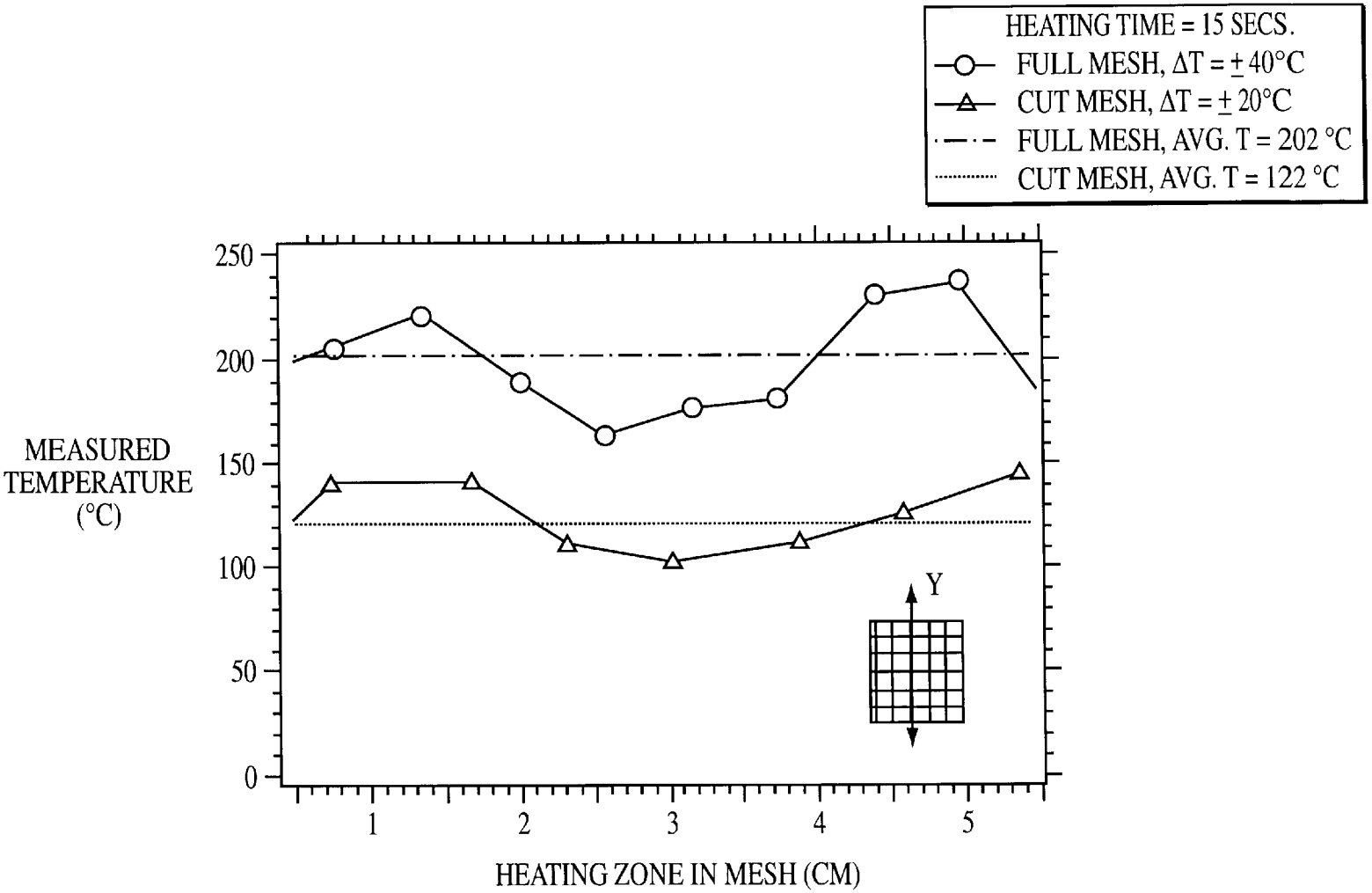
FIG. 12 is a graph showing the experimentally measured temperature profile for a cut mesh pattern compared to the uncut case of FIG. 11.

FIG. 12 shows a heating zone in the mesh, which is the area of the mesh that will show "uniform temperature distribution." Outside this zone, temperatures are much smaller, because of the rapid decay in magnetic field. Heating zones become important when coil motion is considered for large composite parts.

Figure 13:
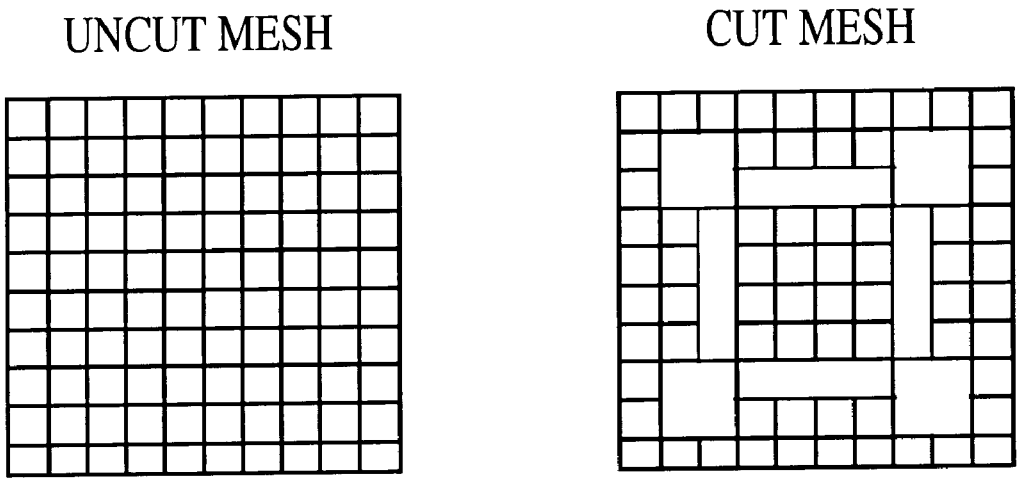
FIG. 13 is a diagram of the uncut and cut mesh patterns for the susceptors having the temperature profiles of FIG. 11 and FIG. 12, respectively.

The measured temperature differential shown in FIG. 11 between the maximum and the minimum points on the mesh is approximately 80° C. (180 to 260° C.). This is not an acceptable range for typical processing windows which are on the order of +/−20° C. Using the method of the present invention, a designed cut pattern can be used to reduce the temperature differential to that as shown in FIG. 12. In this example, the Y-axis temperatures are shown, comparing the measured temperatures for the uncut case in FIG. 11 with the cut case. The corresponding mesh patterns (uncut and cut) are shown in FIG. 13. Cuts were made along the segments showing high induced currents and the temperature differential dropped from 80° C. to 40° C.

While the invention has been described in this specification with some particularity, it will be understood that it is not intended to limit the invention to the particular embodiments provided herein. On the contrary, it is intended to cover all alternatives, modifications, and equivalents as may be included within the spirit and scope of the invention as defined in the appended claims.

What is claimed is:

1. A method of tailoring susceptors for use in induction heating and bonding systems and processes, said susceptors comprising a mesh of electrically conductive material having segments defining a distribution of openings extending therethrough, said method comprising the steps of:

(a) identifying the largest contiguous electrically conductive path induced in said mesh by said induction heating system, said path carrying the largest induced current within said mesh;

(b) cutting segments of the mesh in the area of said path so as to create a new largest induced current path in said mesh; and (c) iterating said steps (a) and (b) until the temperature distribution generated by said new current path in said mesh is within an acceptable range for the induction heating process.

2. The method of claim 1, wherein said step of identifying the path carrying the largest induced current within said mesh comprises using a prediction algorithm to predict induced current patterns in said mesh susceptors.

3. The method of claim 2, wherein said prediction algorithm comprises a resistor network calculation to determine induced voltage (emf) for closed loops in said mesh based on applied magnetic field, and current conservation laws applied to said mesh so that a set of linear algebraic equations are obtained which can be solved for unknown currents in said mesh.

4. The method of claim 3, further comprising calculating the heat generated in segments of the mesh from the geometry of the mesh and the resistivity of the mesh material.

5. The method of claim 3, wherein said prediction algorithm is applied to induction heating systems having different coil shapes, mesh geometry, mesh orientation and position, and mesh density.

6. The method of claim 1, wherein said susceptor material is selected from the group consisting of metals, metal alloys, graphite, and conductive polymers.

7. The method of claim 6, wherein said metals include copper, aluminum, nickel, silver, gold, steel, iron, cobalt, and alloys of said metals.

8. The method of claim 6, wherein said conductive polymer comprises polyaniline.

9. The method of claim 1, wherein said susceptor is embedded within a polymer to enhance bonding between the composite parts.

10. The method of claim 9, wherein said polymer is selected from the group consisting of thermoset adhesives and thermoplastics.

11. A susceptor for use in induction heating, said susceptor comprising a mesh of electrically conductive material having segments defining openings extending therethrough, and wherein said susceptor is tailored by:

(a) predicting an area of said mesh which will carry the largest induced current;

(b) cutting segments of said mesh in said area; and (c) iterating said steps (a) and (b) until the temperature gradient induced by said current in said mesh is more uniform and within acceptable limits for said induction heating process.

12. The susceptor of claim 11, wherein said electrically conductive material is selected from the group consisting of metals, metal alloys, and conductive polymers.

13. The susceptor of claim 12, wherein said metals include copper, aluminum, silver, gold, steel, iron, nickel, cobalt, and alloys of said metals.

14. The susceptor of claim 12, wherein said conductive polymer comprises polyaniline.

15. The susceptor of claim 11, wherein said mesh is embedded within a polymer so that bonding between said composite parts is enhanced.

16. The susceptor of claim 15, wherein said polymer is selected from the group consisting of thermoset adhesives and thermoplastics.

17. A method of bonding composite parts using an induction heating process, comprising the steps of:

(a) tailoring a mesh susceptor by identifying the largest contiguous electrically conductive path induced in said mesh by said induction heating process, said path carrying the largest induced current within said mesh;

(b) cutting segments of said mesh in the area of said path so as to create a new largest induced current path in said mesh;

(c) iterating said steps (a) and (b) until the temperature distribution generated by said new current path is within an acceptable range for the induction process;

(d) positioning said tailored mesh susceptor and a polymer between said composite parts to define a bondline; and (e) heating the tailored mesh susceptor with an induction coil to bond said composite parts.

18. The method of claim 17, wherein said mesh susceptor is embedded within a polymer to enhance bonding between the composite parts.

19. The method of claim 18, wherein said polymer is selected form the group consisting of thermoset adhesives and thermoplastics.

* * * * *